US010991527B2

(12) United States Patent
Huebner et al.

(10) Patent No.: US 10,991,527 B2
(45) Date of Patent: Apr. 27, 2021

(54) CONTACT PIECE FOR A HIGH-VOLTAGE CIRCUIT BREAKER AND METHOD FOR PRODUCING SAME

(71) Applicant: SIEMENS AKTIENGESELLSCHAFT, Munich (DE)

(72) Inventors: Sebastian Huebner, Berlin (DE); Martin Krehnke, Berlin (DE); Volker Lehmann, Treuenbrietzen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/336,295

(22) PCT Filed: Sep. 5, 2017

(86) PCT No.: PCT/EP2017/072184
§ 371 (c)(1),
(2) Date: Mar. 25, 2019

(87) PCT Pub. No.: WO2018/059882
PCT Pub. Date: Apr. 5, 2018

(65) Prior Publication Data

US 2019/0244776 A1 Aug. 8, 2019

(30) Foreign Application Priority Data

Sep. 27, 2016 (DE) ..... 10 2016 218 518.7

(51) Int. Cl.
*H01H 1/02* (2006.01)
*H01H 1/38* (2006.01)
(Continued)

(52) U.S. Cl.
CPC ..... *H01H 33/7038* (2013.01); *H01H 1/0206* (2013.01); *H01H 1/38* (2013.01);
(Continued)

(58) Field of Classification Search
CPC ..... H01H 1/385; H01H 1/0206; H01H 11/04; H01H 11/06; H01H 33/664;
(Continued)

(56) References Cited

U.S. PATENT DOCUMENTS 4,420,662 A * 12/1983 Niemeyer ..... H01H 33/7069 218/53
4,658,108 A * 4/1987 Mauthe ..... H01H 33/901 218/66
(Continued)

FOREIGN PATENT DOCUMENTS

CN 1125996 A 7/1996
CN 1393900 A 1/2003
(Continued)

OTHER PUBLICATIONS

Translation DE69708466 (original document published Jul. 4, 2002) (Year: 2002).*
(Continued)

*Primary Examiner* — William A Bolton
(74) *Attorney, Agent, or Firm* — Laurence Greenberg; Werner Stemer; Ralph Locher

(57) ABSTRACT

A contact piece for a high-voltage circuit breaker includes at least a contact pin and a contact carrier. The contact carrier is configured to mechanically fasten the contact pin in the high-voltage circuit breaker. The contact pin includes a contact shaft. The contact carrier and the contact shaft are formed as a monolithic contact element. A method for producing a contact piece is also provided.

18 Claims, 3 Drawing Sheets

(51) Int. Cl.

| | |
|---|---|
| ***H01H 11/04*** | (2006.01) |
| ***H01H 11/06*** | (2006.01) |
| ***H01H 33/664*** | (2006.01) |
| ***H01H 33/70*** | (2006.01) |
| ***H01H 71/12*** | (2006.01) |

(52) U.S. Cl.
CPC ..... *H01H 1/385* (2013.01); *H01H 11/04* (2013.01); *H01H 11/06* (2013.01); *H01H 33/664* (2013.01); *H01H 33/7076* (2013.01); *H01H 71/12* (2013.01); *H01H 33/70* (2013.01); *H01H 2205/002* (2013.01)

(58) Field of Classification Search
CPC ..... H01H 33/7076; H01H 33/56; H01H 33/7053; H01H 33/901; H01H 33/7038; H01H 33/904; H01H 33/18; H01H 71/12; H01H 2033/028; H01H 2205/002; B22D 19/00; B22D 19/04
USPC ..... 218/146, 48, 53, 57, 60, 61, 63, 65; 29/874, 888.047
See application file for complete search history.

(56) References Cited

U.S. PATENT DOCUMENTS

| | | | | |
|---|---|---|---|---|
| 5,663,544 | A | 9/1997 | Niemeyer | |
| 6,015,960 | A | 1/2000 | Girodet et al. | |
| 7,041,928 | B2 * | 5/2006 | Nowakowski | H01H 33/91 218/45 |
| 7,642,480 | B2 * | 1/2010 | Ozil | H01H 33/904 200/258 |
| 7,679,021 | B2 * | 3/2010 | Gericke | H01H 11/041 218/146 |
| 2002/0195425 | A1 | 12/2002 | Perret et al. | |
| 2007/0246444 | A1 * | 10/2007 | Saxl | H01H 1/385 218/16 |
| 2014/0346147 | A1 | 11/2014 | Blanchet et al. | |
| 2015/0228427 | A1 | 8/2015 | Kim | |

FOREIGN PATENT DOCUMENTS

| | | | |
|---|---|---|---|
| CN | 102723230 | A | 10/2012 |
| DE | 19803974 | C1 | 8/1999 |
| DE | 69708466 | T2 | 7/2002 |
| EP | 0907195 | A1 | 4/1999 |
| EP | 0997195 | A1 | 5/2000 |
| JP | H11173860 | A | 3/1999 |

OTHER PUBLICATIONS

Translation CN102723230 (Original document published Oct. 10, 2012) (Year: 2012).*

Holm Ragnar: " Electric Contacts: Theory and Application; §3 The contact resistance. General theory"; Excerpt from textbook; Springer; Dec. 2010 (reprint from 1967); p. 9.

Beijing Institute of Technology: "Fundamentals of Precision in Machinery Design", published Jan. 31, 1981, pp. 86-89—Translation of p. 88.

* cited by examiner

CONTACT PIECE FOR A HIGH-VOLTAGE CIRCUIT BREAKER AND METHOD FOR PRODUCING SAME

BACKGROUND OF THE INVENTION

Field of the Invention

The invention relates to a contact piece for a high-voltage circuit breaker and to a method for producing the contact piece, wherein the contact piece comprises at least one contact pin and one contact carrier. The contact carrier is designed to mechanically fasten the contact pin in the high-voltage circuit breaker. The contact pin comprises a contact shaft.

Circuit breakers for switching high voltages and currents, in particular in the region of up to 1200 kV and of up to a few 1000 A, are made up of a large number of parts and/or elements. Electrically conductive parts have to exhibit good electrical contact, with low resistance to adjoining contact parts, at contact points or contact areas. Switching movements take place very rapidly, that is to say in the range of milliseconds up to a few seconds. Large forces act on moving parts, such as moving contact pieces or electrodes for example, parts of the kinematic chain, such as drive rods and parts of a transmission and also of the drive itself for example, during switching. Mechanically guided parts have to be very precisely manufactured and guided so that there is no deformation, resulting in destruction, in the event of rapid movements. Parts which are mechanically connected to one another have to have a very stable connection which remains stable under the high forces and accelerations that occur and suppresses undesired relative movements of parts which are connected to one another.

Switching of a high-voltage circuit breaker takes place by opening or closing at least one electrical contact. Arcs can be produced in the process, which arcs are extinguished, for example, by means of a switching gas. In order to allow arcs to be extinguished in a simple manner, high-voltage circuit breakers generally comprise rated current contacts, comprising at least two rated current contact pieces, and arc contacts, comprising at least two arc contact pieces. The contact pieces of a contact have to be moved relative to one another during switching, for example by moving a movable contact piece in relation to a stationary contact piece.

In this case, an arc contact piece can be formed, for example in the form of a sleeve, at one end and the opposite arc contact piece can be formed, for example in the form of a pin, at an opposite end. When the arc contact pieces move relative to one another during switching, the pin-like arc contact piece is inserted into the sleeve-like arc contact piece when the circuit is closed and is withdrawn from the sleeve-like arc contact piece when the circuit is opened. At least one arc contact piece can be guided and moved, for example, in a switching gas nozzle in order to blow on and extinguish the arc by means of a directed flow of switching gas through the nozzle. When a pin-like arc contact piece is inserted into a sleeve and/or nozzle, only a small movement or no movement of the contact pieces perpendicular in relation to the switching movement, in particular no oscillating movement perpendicular in relation to the switching movement, should take place in the event of rapid switching movement since this can lead to tilting of the contact piece in the sleeve and/or nozzle, this making insertion into the sleeve and/or nozzle impossible. Tilting or collision of contact pieces can lead to damage, this resulting in irreversible destruction of the contact pieces.

In order to avoid a movement, in particular an oscillating movement perpendicular in relation to the switching movement of the contact pieces, the pin-like arc contact piece in particular has to be of very stable construction and individual elements of the arc contact piece have to be mechanically fixedly connected to one another and to other elements and/or parts of the high-voltage circuit breaker. In order to produce stable connections, elements and/or parts are, for example, fixedly screwed or adhesively bonded to one another. Good electrical contact for electrically conductive elements over the contact point of different elements has to be ensured during the joining operation. Stable assembly by screw connection and/or adhesive bonding is complicated, cost- and time-intensive and, under certain circumstances, complex. In particular, precise manufacturing, with elements which are exactly aligned with one another, in order to prevent tilting or wedging of contact pieces one in the other and in order to produce a connection which is stable over the long term and prevents and/or counteracts oscillating movements, is very complicated and also cost- and time-intensive.

SUMMARY OF THE INVENTION

The object of the present invention is to avoid and/or reduce the above-described problems. A particular object is to specify a contact piece for a high-voltage circuit breaker and a method for producing the contact piece, which contact piece and method allow a mechanically stable contact piece which is manufactured from different elements and suppresses specific movements, such as oscillating movements for example, during switching.

According to the invention, the specified object is achieved by a contact piece for a high-voltage circuit breaker having the features recited in the independent product claim and/or by a method for producing the contact piece performing the steps recited in the independent method claim. Advantageous refinements of the contact piece according to the invention for a high-voltage circuit breaker and/or of the method for producing the contact piece are specified in the dependent claims. Here, subjects of the main claims can be combined with one another and with features of dependent claims and also features of the dependent claims can be combined with one another.

A contact piece according to the invention for a high-voltage circuit breaker comprises at least one contact pin and one contact carrier. The contact carrier is designed to mechanically fasten the contact pin in the high-voltage circuit breaker. The contact pin comprises a contact shaft. The contact carrier and the contact shaft are designed as a monolithic contact element.

The monolithic design of the contact carrier and of the contact shaft results in a mechanically stable contact element and therefore allows a mechanically stable contact piece. Owing to the monolithic design, that is to say the use of a contact carrier and contact shaft made up of one piece, and high mechanical stability of the resulting contact element, movements of the contact shaft relative to the contact carrier, in particular in the form of oscillating movements, are reduced and/or completely suppressed during switching. The contact element can be produced in a simple and cost-effective manner, without fluctuations in shape due to manufacture. An exact design of the contact element, in particular with substantially vertical arrangement of the contact shaft on the base area of the contact carrier, is reproducible, can be produced with the same shape. The ability to precisely manufacture the contact element in a simple and cost-effective manner, with elements which are exactly aligned with one another, prevents tilting or wedging of contact pieces one in the other during switching and produces a connection, which is stable over the long term, between the contact carrier and the contact shaft, this connection preventing and/or counteracting oscillating movements in particular. As a result, a high degree of reliability and damage-free operation of the high-voltage circuit breaker over long periods of time can be made possible.

The contact piece can be a fixed or a movable contact piece of an arc contact. The low manufacturing tolerance of the contact element is advantageous, in particular in interaction with a sleeve-like second contact piece and/or a switching gas nozzle. Manufacture of a contact element with a contact shaft or contact pin which is screwed or adhesively bonded into the contact carrier entails the risk of production-related deviations in the position of the contact pin in relation to the contact carrier. Precise manufacture for problem-free insertion of the pin-like arc contact piece into a sleeve-like contact piece or into a switching gas nozzle is complicated and cost-intensive. Owing to manufacture from one piece, that is to say owing to manufacture of a monolithic contact piece, the complexity of manufacture is reduced and production-related tolerances are reduced in comparison with contact pieces which are detachably assembled from a plurality of parts. This results in the above-described advantages.

The contact carrier and the contact shaft can consist of a jointly produced cast part. As an alternative, the contact element can consist of a cast part, wherein the contact shaft is cast into the contact carrier as an insert part. In particular when both parts are composed of the same material, casting of the contact carrier and the resultant heating of the contact shaft, in particular with local melting, results in connection of the two parts which is mechanically stable over the long term.

The contact pin can comprise a contact tip which is fastened to the contact shaft, in particular by welding. The contact tip can be arranged at one end of the contact shaft, in particular opposite the contact carrier or opposite that end of the contact shaft which is connected, for example, to the base area of the contact carrier.

The contact shaft and/or the contact carrier can be composed of aluminum, steel, copper or copper/chromium/zirconium or comprise aluminum, steel, copper or copper/chromium/zirconium. These materials are highly electrically conductive and mechanically stable. The contact tip can be composed of tungsten/copper and/or graphite or comprise tungsten/copper and/or graphite. As a result, mechanically stable contact pieces with good electrical properties can be created, which contact pieces, owing to the contact tip, have good erosion properties under the action of an arc and also good electrical conductivity over the contact carrier and the contact shaft.

The contact carrier can be designed in the form of a hollow cylinder and/or the contact pin can be designed substantially in the form of a cylindrical rod, with an increasing cross section in the region of the connection between the contact pin and the contact carrier. An increasing cross section increases the mechanical stability and results in good electrical conductivity over the contact piece.

The contact carrier can comprise a web which is arranged, in particular, on the base area of the contact carrier. The contact shaft can be arranged on the web, in particular in the center of the web, with a longitudinal axis of the contact shaft perpendicular in relation to a longitudinal axis of the web. This results in an opening in the base area of the contact carrier, via which opening, in particular, flow of switching gas is possible and/or owing to which opening material is saved, as a result of which the mass to be accelerated during switching can be reduced.

Fastening elements can be comprised by the contact piece, in particular threaded bores on an outer periphery of the base area of the cylindrical contact carrier. As an alternative or in addition, fastening elements can be arranged along an outer circumference of the cylindrical contact carrier in a region of the end of the contact carrier opposite that end at which the contact pin is fastened to the contact carrier. The contact piece can be fastened in the high-voltage circuit breaker by means of the fastening elements, for example as a fixed contact piece or as a movable contact piece on elements of the kinematic chain. By way of example, the contact piece can be fastened and, in particular, spatially fixed by means of the threaded bores in the high-voltage circuit breaker with the aid of screws.

As an alternative or in addition, fastening elements can also be comprised by the contact piece, in the form of a brim-like element, which encircles the contact carrier, in the region of the base area of the cylindrical contact carrier. The fastening elements can be designed, in particular, as a clamping face and/or for threaded bores. As an alternative or in addition, fastening elements can be designed as a brim-like element, which encircles the contact carrier, in the region close to the top face of the cylindrical contact carrier, in particular designed as a clamping face and/or for threaded bores. As an alternative or in addition to threaded bores, continuous openings for screw connections can be provided. Screw and clamping connections result in good, mechanically stable fastening, in particular, of the contact piece in the high-voltage circuit breaker, with the above-described advantages.

A method according to the invention for producing an above-described contact piece comprises the contact carrier and the contact shaft being designed as a monolithic contact element, in particular in one production step.

The contact carrier and the contact shaft can be formed by casting, in particular by casting aluminum, to form a monolithic contact element.

The contact shaft, in particular composed of aluminum, steel, copper and/or copper/chromium/zirconium, can be arranged as an insert part in a mold for producing the contact carrier, and is cast into the contact carrier during casting.

The contact tip, in particular composed of tungsten/copper and/or graphite, can be fastened by welding, in particular to one end of the contact shaft, for example opposite the contact carrier.

The advantages of the method according to the invention for producing an above-described contact piece as claimed are analogous to the above-described advantages of the contact piece for a high-voltage circuit breaker as claimed, and vice versa.

DESCRIPTION OF THE INVENTION

Figure 1:
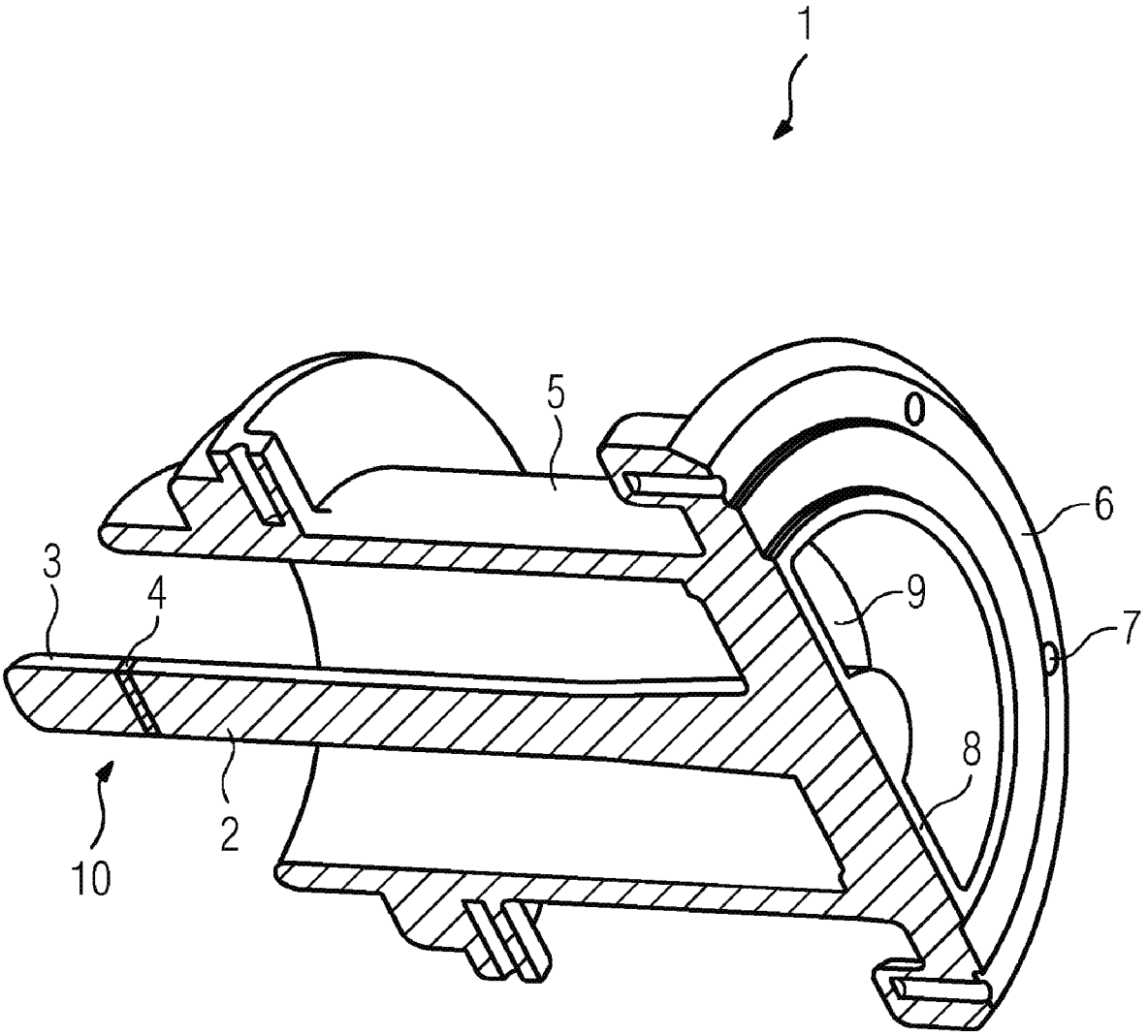
FIG. 1 shows an exemplary embodiment of the invention which is schematically illustrated in the figure and described in more detail below.
Figure 2:
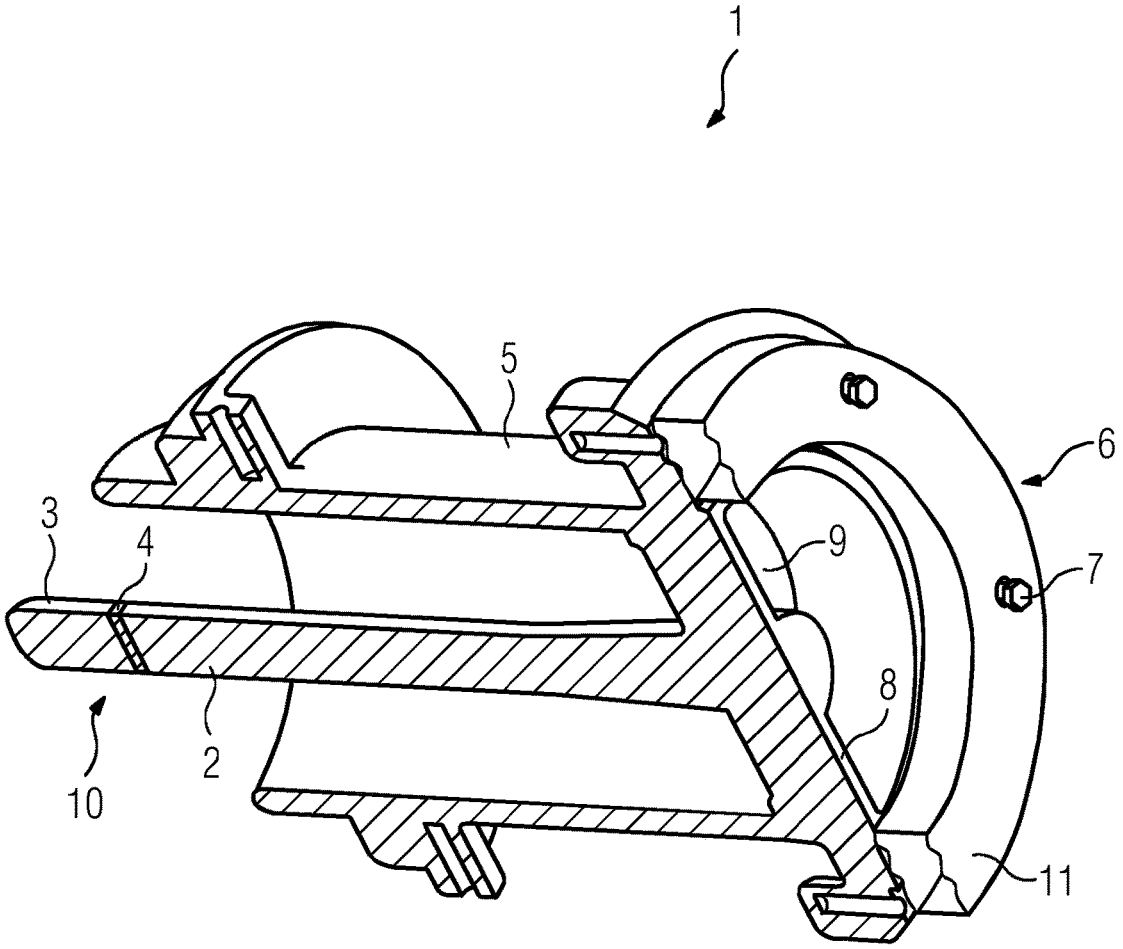
FIG. 2 is a view similar to FIG. 1 which includes a portion of a high-voltage circuit breaker.
Figure 3:
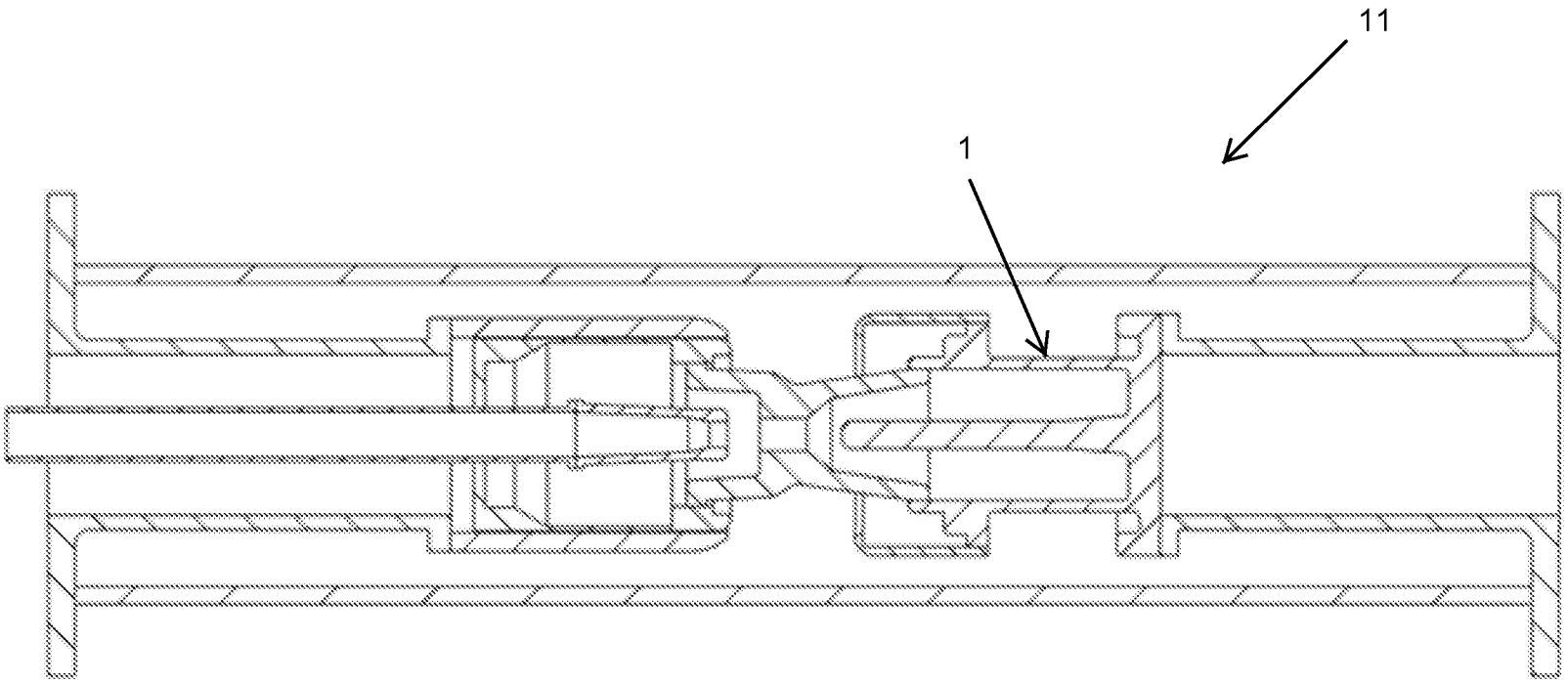
FIG. 3 is a longitudinal-section view showing the contact piece in the circuit breaker.

FIG. 1 schematically shows a sectional illustration of a monolithic contact piece 1 according to the invention of a high-voltage circuit breaker, comprising a contact shaft 2 of a contact pin 10 and comprising a contact carrier 5. The high-voltage circuit breaker 11 is shown partly in FIG. 2 and more completely in FIG. 3.

The single FIGURE schematically shows a sectional illustration of a monolithic contact piece 1 according to the invention of a high-voltage circuit breaker. For the sake of simplicity, the FIGURE does not illustrate a second contact piece which is associated with the monolithic contact piece 1 in the high-voltage circuit breaker, wherein both contact pieces produce a switchable electrical contact, for example an arc contact. A second contact, for example a hollow-cylindrical rated current contact, can be arranged in the high-voltage circuit breaker, in particular formed around an arc contact. When the high-voltage circuit breaker is activated, the arc contact is first closed, that is to say the arc contact pieces are brought into mechanical and electrical contact, and subsequently the rated current contact is closed, that is to say the rated current contact pieces are brought into mechanical and electrical contact. When the high-voltage circuit breaker is deactivated, the rated current contact is first opened and subsequently the arc contact is opened.

An arc, which can be produced between the arc contact pieces during switching, can be extinguished by a switching gas, in particular $SF_6$. To this end, the contact pieces or the intermediate space, in particular between the arc contact pieces, are/is supplied with switching gas. A switching gas nozzle can be provided, in particular arranged around the arc contact, in order to produce a desired switching gas flow at the contact pieces. The switching gas nozzle, arranged between the arc contact and the rated current contact, can electrically shield the arc contact from the rated current contact. In addition or as an alternative, electrodes can be provided for shielding and for controlling the switching gas flow during switching.

The FIGURE illustrates a contact piece, by way of example a monolithic contact piece 1 according to the invention. In the exemplary embodiment of the FIGURE, the contact piece 1 comprises a contact pin 10 as arc contact piece and a cylindrical contact carrier 5, which is arranged symmetrically around the contact pin 10, for fastening the contact pin 10 and also can serve, in particular, as a rated current contact piece. The contact piece 1 in the FIGURE is designed, in particular, as a fixed contact piece relative to which movable contact pieces are moved during switching. As an alternative, the contact piece 1 can be moved by means of elements of the kinematic chain of the high-voltage circuit breaker, which elements are not illustrated in the FIGURE for reasons of simplicity.

In the exemplary embodiment of the FIGURE, the contact pin 10 of the contact piece 1 is designed in the form of a rod, with a circular-cylindrical cross section. The contact pin 10 comprises a contact shaft 2 and a contact tip 3 which are connected to one another, in particular by welding. The contact pin 10 is connected to the contact carrier 5 at a first end of the contact shaft 2. In the region of the connection, the cross section of the contact shaft 2 or of the contact pin 10 increases continuously in the direction of the contact carrier 5. This provides a high degree of mechanical stability and a large cross section for good current flow in the connection region when the contact is closed. The pin tip 3 is arranged at a second end of the contact shaft 2, opposite the first end. The pin tip 3 can consist of tungsten/copper or comprise tungsten/copper, for high erosion resistance to an arc and for good electrical conductivity in contact with the second arc contact piece when the contact is closed.

The contact shaft 2 can consist of a highly conductive, mechanically stable metal, in particular aluminum, steel, copper or copper/chromium/zirconium, or comprise the metal. Alloys of the materials of the pin tip 3 and of the contact shaft 2 can be present at the connection point 4 between pin tip 3 and contact shaft 2, in particular in the case of welding. The pin tip 3 is rounded at that end which is situated opposite the connection point 4, in order to prevent tilting or jamming with the opposite contact piece of the contact during switching. In the case of a sleeve-like opposite contact piece, which is not illustrated in the FIGURE for the sake of simplicity, in the event of activation, the sleeve of the opposite contact piece is pushed over the contact pin 10 in such a way that good electrical contact between the contact pin 10 and the opposite contact piece is produced. In the event of deactivation, the sleeve of the opposite contact piece is withdrawn from the contact pin 10, until there is no longer any electrical contact between the two contact pieces.

The contact carrier 5 is substantially hollow-cylindrical, with a web 8 on the base area of the cylinder, which web is formed along a diameter of the base area of the cylinder. Between the lateral surface of the cylinder of the contact carrier 5 and the web 8, a continuous recess or passage opening 9 is formed on both sides of the web 8 in the base area. For example, switching gas can flow through the passage opening 9 during switching; heated switching gas can flow away for extinguishing an arc and/or after the arc has been extinguished.

The contact pin 10 is arranged in the central point of the base area of the circular-cylindrical contact carrier 5, in the center of the web 8. The longitudinal axis of the contact pin 10 or of the contact shaft 2 is equal to the longitudinal axis or center axis of the cylindrical contact carrier 5. According to the invention, the contact shaft 2 of the contact pin 10 and the contact carrier 5 with the web 8 are designed in a monolithic manner, that is to say from one piece, in particular without a screw or adhesive-bonding connection. The monolithic contact element comprising contact carrier 5 with web 8 and contact shaft 2 can be manufactured from a casting, that is to say can be cast as one piece in a mold. As an alternative, the monolithic contact element can be produced from a contact shaft 2 which is inserted into a mold as insert part and the contact carrier 5 with web 8 is produced by casting in the mold. The contact shaft 2 is cast into the contact carrier 5 or into the web 8, and a monolithic piece is produced, in particular when contact carrier 5 and contact shaft 2 are composed of the same material.

The contact pin 10 with a congruent longitudinal axis in relation to the longitudinal axis of the cylindrical contact carrier 5 is positioned vertically on the web 8 and also on the base area of the cylindrical contact carrier 5. This allows exact adjustment or arrangement in the high-voltage circuit breaker, with congruent longitudinal axes of the two contact pieces of a contact, in particular of an arc contact. The longitudinal axis of a sleeve-like contact piece can be arranged exactly congruently to the longitudinal axis of the contact pin 10 and the contact pin 10 can be fixed such that it is stable over the long term in the spatial position in the high-voltage circuit breaker. As a result, tilting or jamming or irreversible destruction of the contact pieces can be avoided during switching.

Fastening elements 7 are arranged in the contact carrier 5 for spatial fixing. As fastening element 7, the base area of the cylindrical contact carrier 5 can be increased in size toward the outside analogously to a brim of a hat. The brim can serve as a clamping face for clamping in the high-voltage circuit breaker, for example by means of clamping springs. As an alternative or in addition, threaded bores or continuous bores can be provided as fastening elements 7, in particular in the brim, by means of which bores the contact piece 1 is fastened and fixed in the high-voltage circuit breaker with the aid of screws. A second brim can be arranged on the outside of the cylindrical contact carrier 5, in a manner shifted parallel to the first brim spatially along the longitudinal axis of the contact piece 1, with the function described above for the first brim, in particular likewise with threaded bores and/or continuous bores as fastening elements 7 for fastening and fixing the contact piece 1 in the high-voltage circuit breaker, for example with the aid of screws and/or clamps.

The open end of the cylindrical contact carrier 5, which end is situated opposite the end of the contact carrier 5 with the web 8, can serve as rated current contact piece. The open hollow cylinder of the contact carrier 5 can be arranged opposite a rated current contact piece, with contact fingers arranged on a cylinder periphery for example, with congruent longitudinal axes of the cylindrical rated current contact pieces. During switching, the contact fingers of the cylindrical rated current contact piece, which is not illustrated in the FIGURE for reasons of simplicity, are pushed over, in particular, the outer periphery of the contact carrier 5 in the event of activation, or withdrawn when the high-voltage circuit breaker is deactivated. The rated current contact is closed and, respectively, opened in this way.

Owing to the monolithic design of the contact shaft 2 with the contact carrier 5, good electrical conductivity over the entire contact piece 1 is provided, in accordance with the material selection, in particular the use of aluminum, steel, copper or copper/chromium/zirconium. Electrical line losses when the high-voltage circuit breaker is activated, in particular at screw or adhesive-bonding connections of the contact pin 10 to the contact carrier 5, can be avoided. Deviations from a spatial position of the contact pin 10, with congruent longitudinal axes of the contact pin 10 and of the contact carrier 5, which can lead to tilting, jamming and destruction of the contact pieces during switching are avoided owing to the contact piece 10 being produced from a casting. In the case of screw connections of the contact pin 10 and the contact carrier 5 to one another, an exactly congruent position is difficult to produce and changes in the position at high switching speeds are difficult to avoid owing to play of the screw connection.

The above-described exemplary embodiments can be combined with one another and/or can be combined with the prior art. For example, different materials can be used. The contact tip 3 can be produced, for example, from the contact shaft 2 by coating the tip of said contact shaft, for example with carbon, by silver-plating, evaporation-depositing or sputtering conductive, erosion-resistant layers and/or by other coating methods. The contact pin 10 can be designed with a continuously increasing cross section or the cross section can be equal over the entire contact shaft 2. Screw, clamping, adhesive-bonding, welding or other connections can be provided for fastening the contact piece 1 in the high-voltage circuit breaker. Finger-like fastening elements 7 can be provided instead of brims. The fastening elements 7 can also be formed directly in the cylinder casing of the contact carrier 5. The contact carrier 5 can have shapes which differ from round cylinders, such as with an elliptical base area or annular for example.

Instead of a web 8, the base area can be designed to be complete, without opening 9. As an alternative, for example, two webs 8 which are arranged crosswise in relation to one another can be provided. The base area of the contact carrier 5 can be of planar design or, as illustrated in the FIGURE, with annular steps which allow better adjustment and fixing of the contact piece 1 in the high-voltage circuit breaker.

When a contact pin 10 is used as an insert part which is cast into the contact carrier 5 or into the web 8 of the contact carrier 5, it is possible for, for example, an oxide layer as surface coating on the contact shaft 2 to be removed before potting. As a result, good electrical contact and the formation of a monolithic body without intermediate layers are possible during casting. Welding connections of contact carrier 5 and contact shaft 2 can likewise produce a monolithic contact piece 1. Final processing and setting of the contact piece 1 can be performed, for example, after casting or welding. Coaxial deviations in the longitudinal axes of the contact pin 10 and of the contact carrier 5 can be avoided or eliminated in this way. The monolithic design of the contact piece 1 prevents, in particular completely, mechanical play between contact pin 10 and contact carrier 5, giving the above-described advantages.

LIST OF REFERENCE SYMBOLS

1 Contact piece
2 Contact shaft
3 Contact tip
4 Connection point of the contact tip with the contact shaft
5 Contact carrier
6 Base area of the cylindrical contact carrier
7 Fastening element, for example threaded bore
8 Web of the contact carrier
9 Passage opening in the base area of the contact carrier
10 Contact pin

The invention claimed is:

1. A method for producing a contact piece for a high-voltage circuit breaker, the method comprising the following steps:

producing at least one contact pin including a contact shaft and a contact carrier as a monolithic contact element by placing the contact shaft in a mold for producing the contact carrier, and casting the contact shaft as an insert part into the contact carrier during casting;

forming at least part of the contact shaft of a material identical to a material of the contact carrier;

locally melting the contact shaft as a result of the casting of the contact carrier and resultant heating of the contact shaft; and configuring the contact carrier to mechanically fasten the at least one contact pin in the high-voltage circuit breaker.

2. The method according to claim 1, which further comprises forming the contact shaft of at least one of aluminum, steel, copper or copper/chromium/zirconium.

3. The method according to claim 1, which further comprises welding a contact tip to an end of the contact shaft.

4. The method according to claim 3, which further comprises forming the contact tip of at least one of tungsten/copper or graphite.

5. The method according to claim 3, which further comprises welding the contact tip to an end of the contact shaft opposite the contact carrier.

6. A contact piece for a high-voltage circuit breaker, the contact piece comprising:

at least one contact pin including a contact shaft and a contact carrier, said contact carrier configured to mechanically fasten said contact pin in the high-voltage circuit breaker, said contact carrier and said contact shaft being constructed as a monolithic contact element formed as a cast part;

said contact shaft being cast into said contact carrier as an insert part;

at least part of said contact shaft being composed a material identical to a material of said contact carrier, and said contact shaft being locally melted by casting of said contact carrier and resultant heating of said contact shaft.

7. The contact piece according to claim 6, wherein said contact piece is a fixed or a movable contact piece of an arc contact.

8. The contact piece according to claim 6, wherein said contact pin includes a contact tip at least one of fastened to said contact shaft by welding or disposed at one end of said contact shaft opposite to said contact carrier.

9. The contact piece according to claim 6, wherein:

at least one of said contact shaft or said contact carrier is composed of aluminum, steel, copper or copper/chromium/zirconium, or at least one of said contact shaft or said contact carrier includes aluminum, steel, copper or copper/chromium/zirconium.

10. The contact piece according to claim 9, wherein:

said contact tip is composed of at least one of tungsten/copper or graphite, or said contact tip includes at least one of tungsten/copper or graphite.

11. The contact piece according to claim 6, wherein said contact carrier is a hollow cylinder or said contact pin is a cylindrical rod, and a connection region having an increased cross section is disposed between said contact pin and said contact carrier.

12. The contact piece according to claim 6, wherein said contact carrier is a hollow cylinder and said contact pin is a cylindrical rod, and a connection region having an increased cross section is disposed between said contact pin and said contact carrier.

13. The contact piece according to claim 6, wherein said contact carrier includes a web, said contact shaft is disposed on said web, and a longitudinal axis of said contact shaft is perpendicular to a longitudinal axis of said web.

14. The contact piece according to claim 13, wherein said web is disposed on a base area of said contact carrier, and said contact shaft is disposed in a center of said web.

15. The contact piece according to claim 6, wherein said contact piece includes fastening elements.

16. The contact piece according to claim 15, wherein said contact carrier is cylindrical, said fastening elements are threaded bores disposed at least one of on an outer periphery of a base area of said cylindrical contact carrier or in a region of an end of said contact carrier opposite an end at which said contact pin is fastened to said contact carrier, and said threaded bores are disposed along an outer circumference of said cylindrical contact carrier.

17. The contact piece according to claim 15, wherein said contact carrier is cylindrical, and said fastening elements form a brim-shaped element encircling said contact carrier in a region of a base area of said cylindrical contact carrier.

18. The contact piece according to claim 17, wherein said cylindrical contact carrier has a top face, and said fastening elements are provided as at least one of a clamping face or threaded bores or a brim-shaped element encircling said contact carrier in a region of said top face of said cylindrical contact carrier.

* * * * *